United States Patent [19]

Finan, Sr. et al.

[11] Patent Number: 4,689,937

[45] Date of Patent: Sep. 1, 1987

[54] ARTICLE BAGGING UNIT

[76] Inventors: Anthony T. Finan, Sr., 9640 Wissinoning St., Philadelphia, Pa. 19114; Richard K. Lowery, Sr., 1304 Sturbridge Dr.; Walter T. Leible, 915 Roberts Rd., both of Warminster, Pa. 18974

[21] Appl. No.: 904,896

[22] Filed: Sep. 8, 1986

[51] Int. Cl.[4] ..... B65B 1/32

[52] U.S. Cl. ..... 53/502; 53/373; 53/384; 53/385; 53/570; 62/344; 53/167

[58] Field of Search ..... 53/167, 548, 373, 567, 53/384, 570, 385, 571, 502, 572, 573, 550, 551; 62/344

[56] References Cited

U.S. PATENT DOCUMENTS

| | | | |
|---|---|---|---|
| 3,859,775 | 1/1975 | Kihnke | 53/572 |
| 3,913,343 | 10/1975 | Rowland | 62/344 X |
| 3,916,603 | 11/1975 | Kristiansen | 53/384 |
| 4,088,243 | 5/1978 | Deveson | 62/344 X |
| 4,132,049 | 1/1979 | Mullins | 53/572 X |
| 4,235,067 | 11/1980 | Parsons | 53/502 |
| 4,253,292 | 3/1981 | Lipes | 53/384 |
| 4,344,268 | 8/1982 | Wakamatsu et al. | 53/384 |
| 4,368,608 | 1/1983 | Ray | 53/572 X |

*Primary Examiner*—Robert L. Spruill
*Assistant Examiner*—Steven P. Weihrouch

[57] ABSTRACT

An article bagging unit particularly useful in bagging ice cubes. A bag, positioned to receive articles to be bagged, is partially opened by an air blower and then fully opened by two pairs of fingers. Each of the fingers is movable into and out from a bag. After the fingers are moved into a partially open bag, one pair of fingers moves away from the other pair of fingers and spreads the front and the back of the bag. Next, a prescribed quantity of articles is delivered to the bag. Then the fingers are retracted from the bag and a pair of heat-sealing members converge to clamp the tops of the front and the back of the bag to seal the bag.

15 Claims, 20 Drawing Figures

ARTICLE BAGGING UNIT

TECHNICAL FIELD

The present invention relates, in general, to article handling and, in particular, to an ice cube making and bagging machine.

BACKGROUND ART

Ice bagging machines, ice vending machines, and ice bagging and vending machines are not new. Many different forms of these machines are in commercial use or have been suggested by the prior art.

Often, an individual purchasing a bag of ice cubes finds that the ice cubes have frozen together, so that instead of finding individual ice cubes within the bag, the individual finds one or more large masses of ice. This is probably the major shortcoming of bagging ice cubes and then storing the bagged ice cubes.

Most ice cube vending machines, such as the ones found in hotels and motels, are arranged for the user to place a bucket or bag in a dispensing compartment and hold the bucket or bag as ice cubes are delivered. Typically, the user has only a short distance to go, such as back to a room or to a car, so that sealing or closing the bag or ice cube container to prevent spillage of the ice cubes is not an important factor.

Various attempts have been made in the past to provide ice cube bagging and vending machines which bag ice cubes only on demand. In this way, ice cubes are not stored in a bag and subject to the formation of masses of ice in the bag. However, the ice cube bagging and vending machines suggested previously fail to satisfy concurrently the requirements of highly sanitary conditions, dispensing accurately metered amounts of ice cubes, and efficient and fault-free operation.

DISCLOSURE OF THE INVENTION

An ice cube making and bagging machine, constructed in accordance with the present invention, includes an ice cuber for making ice cubes, an ice storage bin for storing ice cubes made by the ice cuber, ice breaking means within the ice storage bin for breaking apart ice cubes stored in the ice storage bin, and an ice bagger for bagging ice cubes. A command unit, activated by a user, initiates operation of the ice bagger and delivery of ice cubes from the ice storage bin to the ice bagger. In addition, ice sensing means are provided for sensing the presence of at least a prescribed minimum amount of ice cubes in the ice storage bin, so that an indication is developed whenever the ice storage bin has less than the prescribed minimum amount of ice cubes. Otherwise, with an adequate supply of ice, the ice bagger and the ice feeding means are actuated on command to fill a bag with ice cubes. In order to assure delivery of ice cubes to the ice bagger, the ice breaking means, within the ice storage bin, are actuated at prescribed times to break apart ice cubes in the storage bin.

The ice cube bagging unit includes means for storing a strip of bags interconnected by perforated lines extending between the top edge of the back of each bag and the bottom of the next bag. These bags are fed to a dispensing compartment and positioned to receive ice cubes delivered from the ice storage bin.

The bags are automatically opened, filled with ice cubes, and closed and sealed after they have been filled. Bag opening is accomplished in two steps. First, an air blower blows air into the top of a bag to separate the tops of the front and back of the bag and partially open the bag. Next, first and second pairs of fingers, movable downward into the bag and upward out from the bag, are moved into the bag. One pair of fingers is fixed relative to opposite directions transverse to the front and the back of the bag, while the other pair of fingers is movable in the transverse directions away from and toward the first pair of fingers. A partially opened bag in the dispensing compartment is fully opened by moving the second pair of fingers away from the first pair of fingers, thereby spreading the front and the back of the bag. A prescribed amount of ice cubes then is delivered to the fully opened bag.

Next, the fingers are moved upward out from the bag and a pair of aligned, heat-sealing members, positioned to engage the outside surfaces of the tops of the front and the back of the bag, are moved in the transverse directions toward each other to close the filled bag and clamp the tops of the front and the back of the filled bag. The bag is sealed when power is applied to one of the heat-sealing members.

A bag filled with ice cubes is separated from the next bag in the strip by the movement of one of the heat sealing members which tears the filled bag from the next bag along the perforated line extending between the bags. Next, the second pair of fingers is moved toward the first pair of fingers and the heat-sealing members are moved in the transverse directions away from each other. The filled and sealed bag of ice cubes then is removed from the dispensing compartment and the bagging unit is ready to fill another bag with ice cubes.

BRIEF DESCRIPTION OF THE DRAWINGS

Referring to the drawings.

BEST MODE FOR CARRYING OUT THE INVENTION

Figure 1:
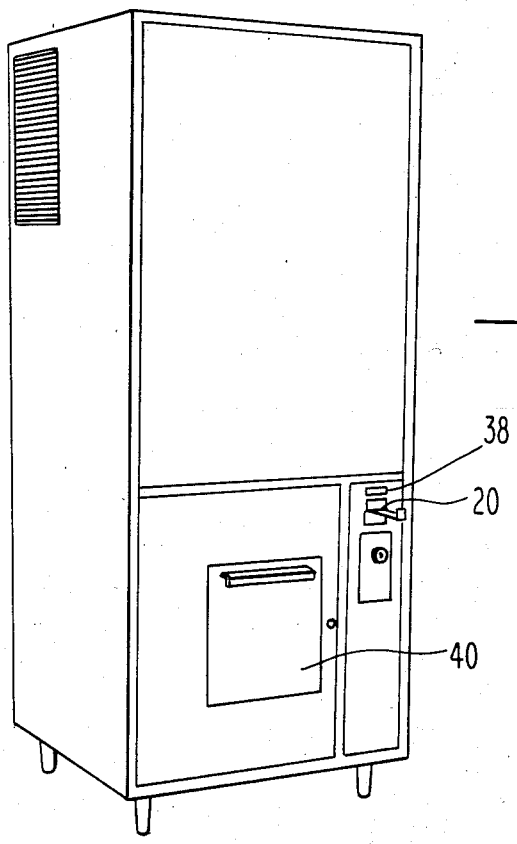
FIG. 1 is a perspective view of the housing of an ice making and bagging machine constructed in accordance with the present invention.
Figure 2:
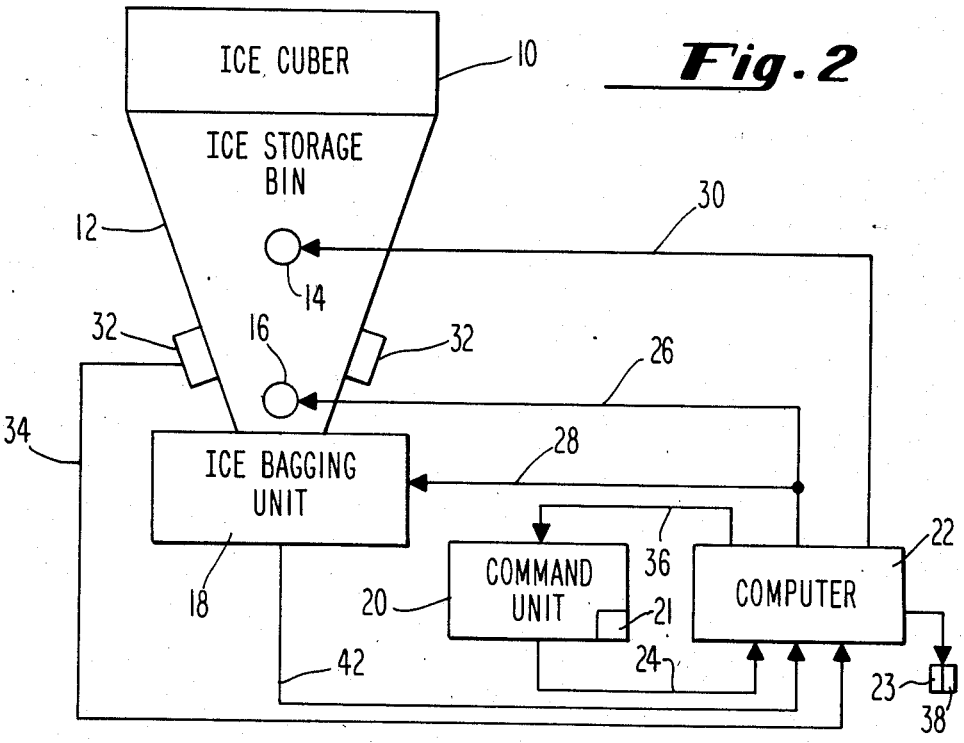
FIG. 2 is a schematic diagram of an ice making and bagging machine constructed in accordance with the present invention.

Referring to FIGS. 1 and 2, an ice cube making and bagging machine, constructed in accordance with the present invention, includes an ice cuber 10 for making ice cubes and an ice storage bin 12 for storing ice cubes made by the ice cuber. Ice cuber 10 can be of conventional construction and operation, such as the one made by Manitowoc Ice Machines and identified by Model GD/0602A, with appropriate modifications. Ice storage bin 12 also can be of conventional construction and operation, such as the one made by Southeastern Dispensing Company and identified by Model SD/400CT, with appropriate modifications. Ice cuber 10 and ice storage bin 12 are mounted in the upper portion of the housing of the ice cube making and bagging machine shown in FIG. 1.

Mounted within ice storage bin 12 is a bridger 14 which rotates and breaks apart ice cubes stored in the ice storage bin. Also mounted within ice storage bin 12 is an auger 16 which rotates and delivers, to an outlet, ice cubes stored in the ice storage bin. Bridger 14 and auger 16 function in the usual manner and, generally, are included in ice storage bins, such as the one previously identified.

An ice cube making and bagging machine, constructed in accordance with the present invention, also includes an ice bagging unit 18 which bags ice cubes delivered from ice storage bin 12 by auger 16. The details of ice bagging unit 18 will be described hereinafter.

A command unit 20 initiates operation of auger 16 and ice bagging unit 18. The command unit can be a coin slot mechanism, as illustrated in FIG. 1, or a push-button. When a coin slot mechanism is used, it includes a coin sensor 21, which confirms the presence of the appropriate coin or coins before initiation of the bagging operation. The command unit supplies signals to control means, identified as a computer 22, along a line 24 which, in turn, energizes an "in operation" indicator 23 and actuates motors and other drive components associated with auger 16 and ice bagging unit 18 by supplying control signals along lines 26 and 28, respectively. In addition, computer 22 actuates bridger 14 at prescribed times by supplying a control signal along a line 30.

The ice cube making and bagging machine shown in FIGS. 1 and 2 also includes sensing means, represented by reference numeral 32, for sensing at least a prescribed minimum amount of ice cubes in ice storage bin 12. When ice storage bin 12 contains less than the prescribed minimum amount of ice cubes, computer 22, in response to a signal supplied from sensing means 32 along a line 34, develops an indication that the ice storage bin has an inadequate supply of ice cubes. This indication is coupled back to command unit 20 along a line 36 to illuminate a light 38 which provides notice to a user that the amount of ice cubes in the machine is inadequate to fulfill an order. Alternatively, the indication supplied along line 36 from computer 22 to command unit 20 can be used to return coins mistakenly inserted or to disable the command unit and prevent the acceptance of coins or other instructions which would initiate operation of auger 16 and ice bagging unit 18 until such time that at least the prescribed minimum amount of ice cubes are stored in ice storage bin 12 and a full bag of ice cubes can be delivered.

Sensing means 32 preferably include a thermal sensor positioned at an appropriate point on storage bin 12 corresponding to the level to which the desired minimum quantity of ice cubes would reach. The thermal sensor provides different indications between the ice cube level not reaching the position of the thermal sensor and the ice cube level reaching or exceeding the position of the thermal sensor.

The bags are filled with ice cubes in a dispensing compartment represented by a drawer 40 in FIG. 1. The drawer is arranged so that it cannot be opened until completion of the bag filling operation. After a bag is filled with ice cubes, the dispensing compartment can be moved from a first position in which the bags are filled with ice cubes to a second position in which a filled bag can be removed.

Various means can be employed to control the amount of ice cubes delivered to a bag. A preferred approach is to include, in the dispensing compartment, a scale upon which the bags rest as they are being filled with ice cubes. The scale produces a signal to which the computer responds to shut off auger 16 when the scale senses a prescribed weight of ice cubes in the bag resting on the scale. This indicates that the prescribed amount of ice cubes has been delivered to the bag. Line 42 in FIG. 2 represents the output signal developed by the scale and also the signal developed upon the completion of the bag-filling operation by which dispensing compartment 40 may be moved to remove the filled bag of ice cubes. Line 28 also represents the control signal from computer 22 which releases the interlock of dispensing compartment 40 which permits moving the dispensing compartment.

Referring to FIGS. 3 through 10, an ice cube bagging unit, constructed in accordance with the present invention, includes means for storing a strip of bags interconnected by perforated lines extending between the top edge of the back of each bag and the bottom of the next bag. Preferably, the bags are stored in a roll 44 mounted on a spindle 46 supported by a pair of brackets 48. Bag roll 44 is arranged to turn counterclockwise, when viewed in FIG. 4, as the end of the rolled strip of bags is pulled.

Figure 6:
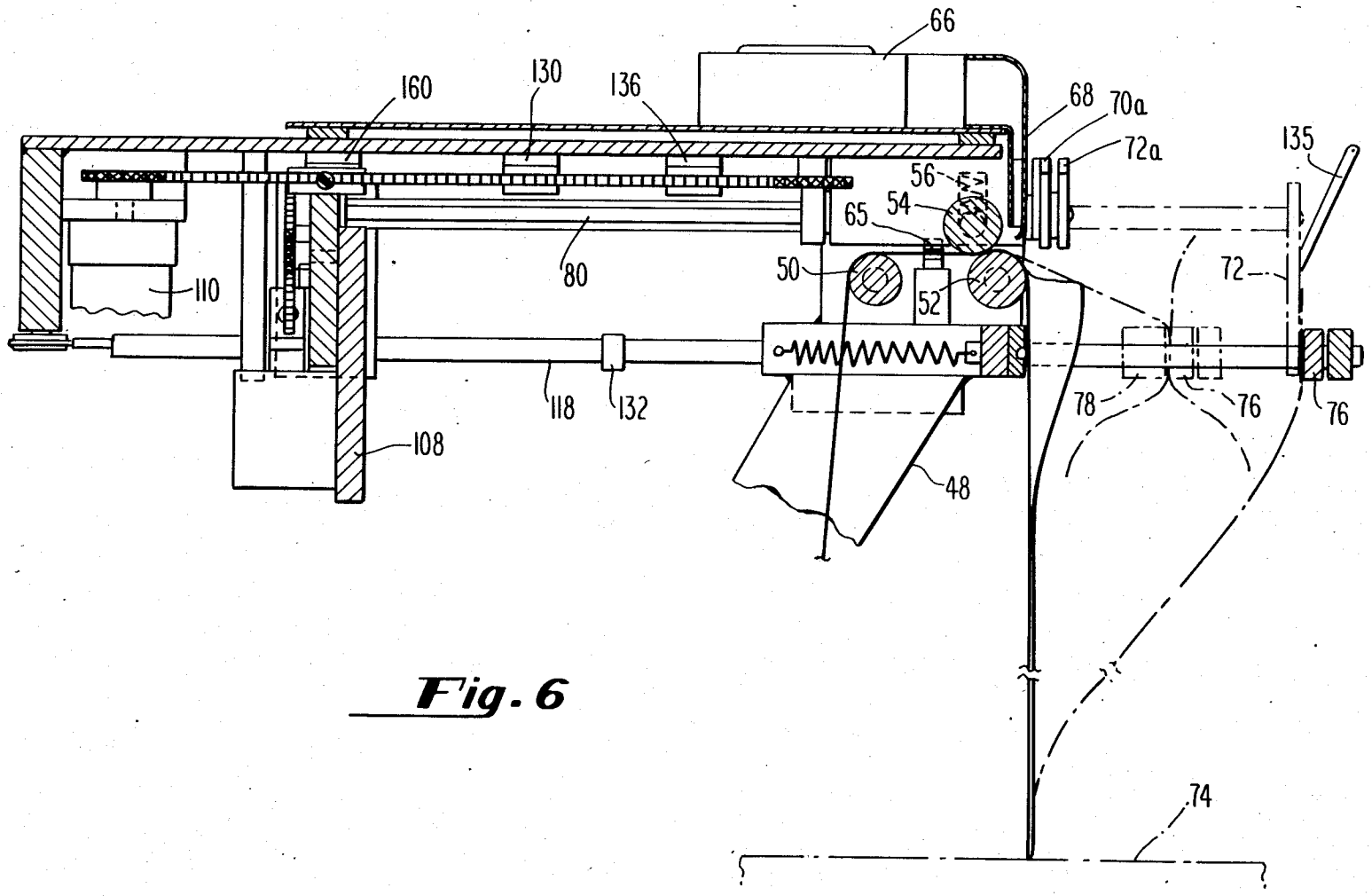
FIG. 6 is a vertical, sectional view taken along line 6—6 of FIG. 3.

The bags are fed to the dispensing compartment where they are positioned to receive ice cubes from the ice storage bin. This is accomplished by an idler roller 50, a driven roller 52, and a pinch roller 54 biased toward roller 52 by a pair of springs 56 positioned at opposite ends of the pinch roller. Only one of the springs 56 is shown in FIG. 6. Roller 52 is driven by a motor 58 mechanically coupled to roller 52 through a chain 60 running between a sprocket 62 mounted at the output of motor 58 and a sprocket 64 mounted on the same shaft as is roller 52. Pinch roller 54 serves two purposes. First, it provides positive traction between roller 52 and the strip of bags which move between roller 52 and pinch roller 54 to draw the strip of bags upward and position a bag in the dispensing compartment. Second, pinch roller 54 serves as a lock against further drawing of the strip of bags while motor 58 is shut off and roller 52 is prevented from rotating, thereby preventing movement of the strip of bags as a bag being filled tends to collapse and draw the next bag in the strip of bags into the dispensing compartment.

Motor 58 is shut off by a signal developed by an optical sensor 65 which is positioned along the path of movement of the strip of bags. In a preferred embodiment of the present invention, each bag has a special marking, such as a dot, which is positioned on the bag to pass optical sensor 65. An indication that a bag has been positioned properly in the dispensing compartment is developed when the dot on the next bag has been sensed by optical sensor 65. Alternatively, the perforations between bags can serve as the markings on the bags. After the perforated line between successive bags passes optical sensor 65 and the sensor has sensed the passage of the perforated line, the sensor develops a signal which indicates that a bag has been positioned properly in the dispensing compartment.

A bag positioned in the dispensing compartment to receive ice cubes from the ice storage bin is connected to the next bag in the strip of bags along a perforated line extending between the top edge of the back of the bag in the dispensing compartment and the bottom of the next bag. As a result, the top of the bag in the dispensing compartment can be opened because the top edge of the front of this bag is not connected to the next succeeding bag.

A bag in the dispensing compartment is partially opened by means of an air blower 66 which blows air into the top of the bag to separate the tops of the front and the back of this bag. Air from air blower 66 is conducted to a bag in the dispensing compartment by means of a funnel 68 which directs the air against the bag strip in the vicinity of the perforated line between adjacent bags. This air is deflected off the surface of the bag strip into the bag positioned in the dispensing compartment to separate the tops of the front and back of this bag and partially open this bag.

Figure 5:
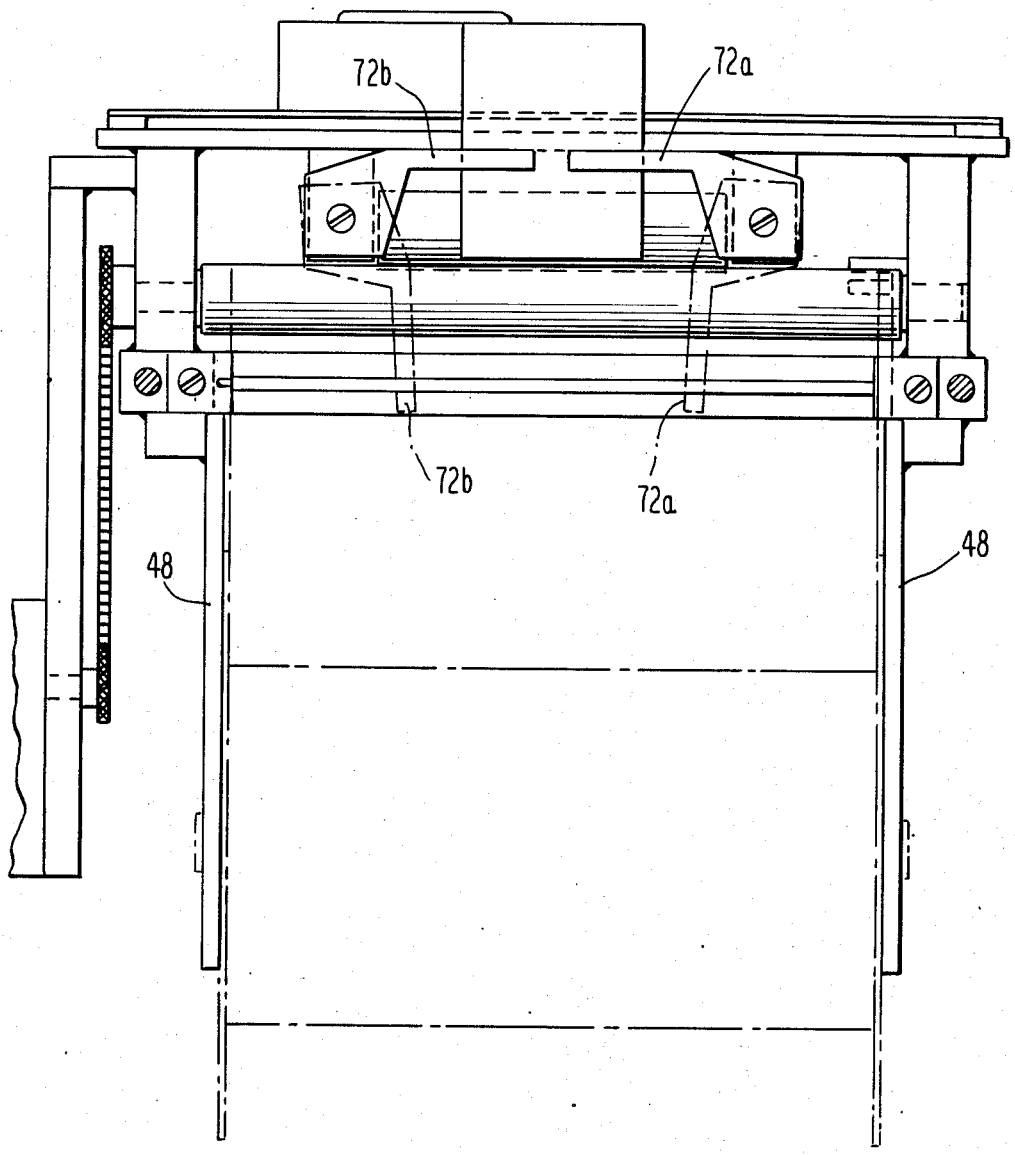
FIG. 5 is a vertical, sectional view taken along line 5—5 of FIG. 4.

The bag in the dispensing compartment is fully opened by means of a first pair of fingers 70*a* and 70*b* and a second pair of fingers 72*a* and 72*b*. Each of the fingers 70*a*, 70*b*, 72*a* and 72*b* is rotatably movable downward into a bag in the dispensing compartment and upward out from this bag. FIG. 5 shows fingers 72*a* and 72*b* in solid lines in their upper position and in phantom rotated into their lower positions.

Fingers 70*a* and 70*b* are fixed relative to opposite directions transverse to the front and the back of the bag in the dispensing compartment. In contrast, fingers 72*a* and 72*b* are movable in the transverse directions away from and toward fingers 70*a* and 70*b*.

After fingers 70*a*, 70*b*, 72*a* and 72*b* are moved downward into a partially opened bag, fingers 72*a* and 72*b* are moved transverse to the front and the back of the bag and away from fingers 70*a* and 70*b*. With fingers 70*a* and 70*b* engaging the inside surface of the back of the bag and fingers 72*a* and 72*b* engaging the inside surface of the front of the bag, the front and the back of the bag spread to fully open the bag as fingers 72*a* and 72*b* move away from fingers 70*a* and 70*b*.

After the bag in the dispensing compartment is fully opened, ice cubes from the ice storage bin are delivered to the dispensing compartment to fill the bag. As the bag fills, a scale 74, shown in FIGS. 4 and 6 at the bottom of the dispensing compartment, senses the weight of the ice cubes deposited in the bag and, when a prescribed amount has been deposited, the scale develops a signal which shuts off the supply of ice cubes. Next, fingers 70*a*, 70*b*, 72*a* and 72*b* are retracted upward out of the filled bag.

Figure 3:
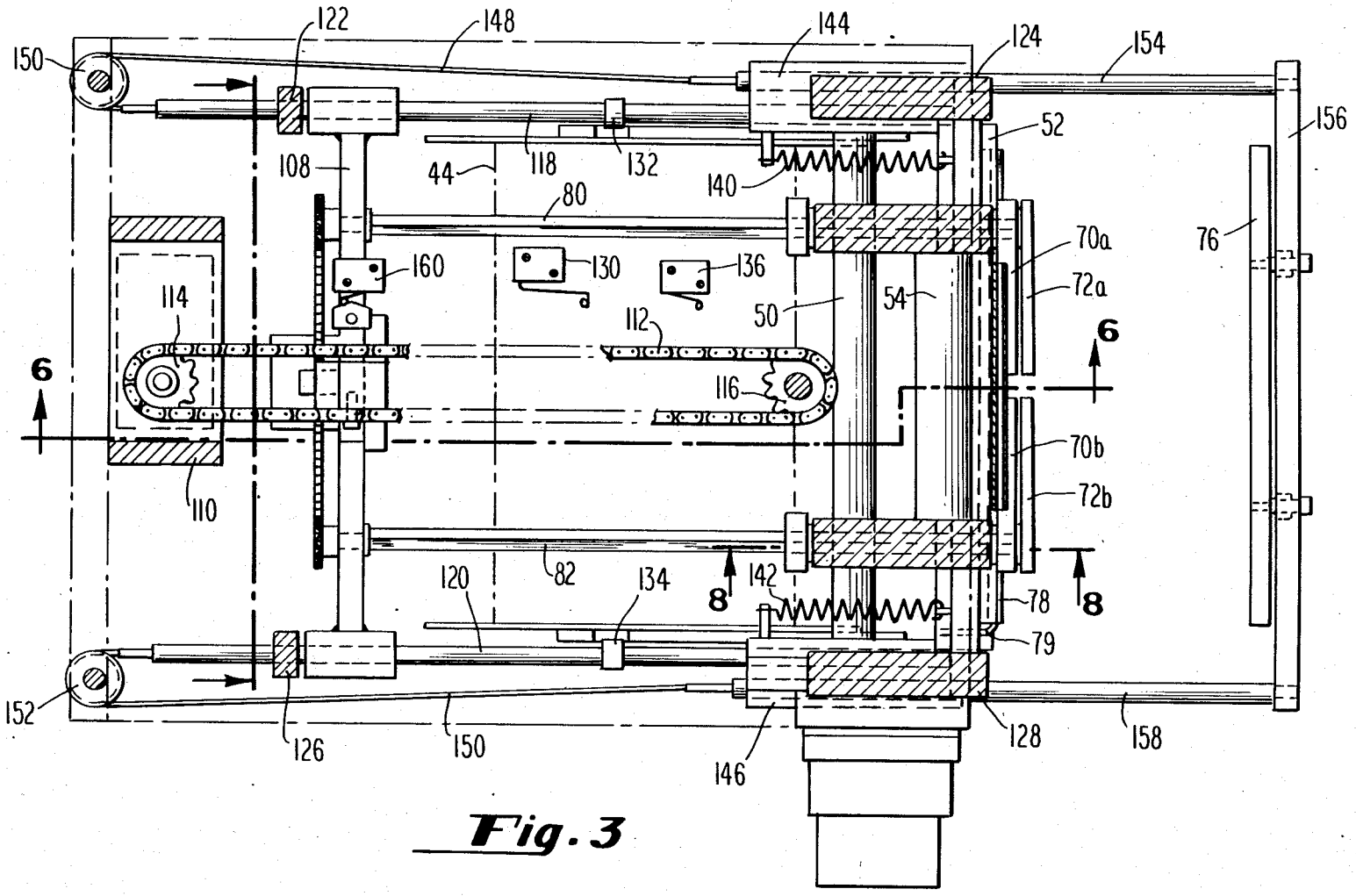
FIG. 3 is a plan view of the bagging unit portion of the FIGS. 1 and 2 machine.
Figure 4:
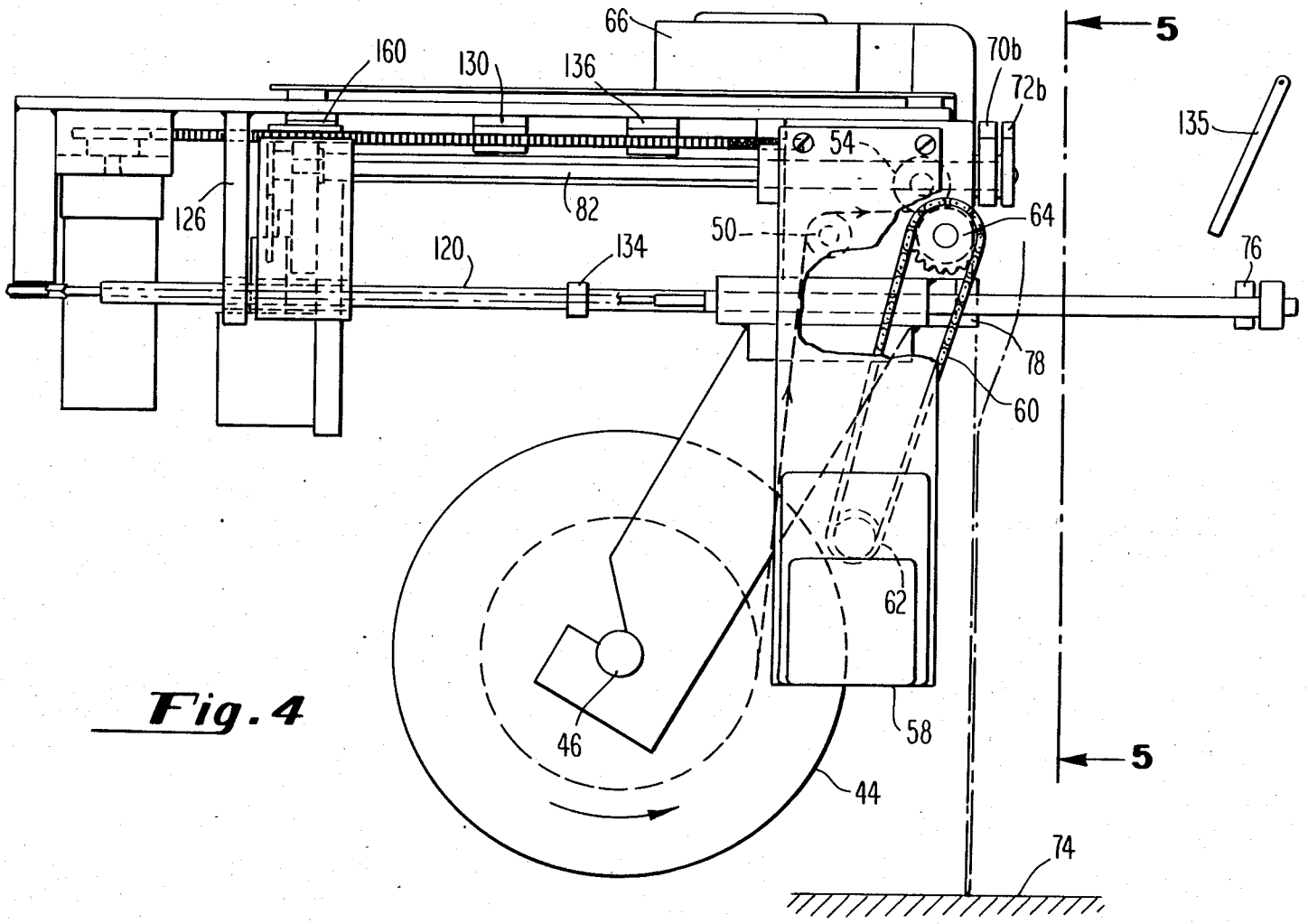
FIG. 4 is a side view of the bagging unit portion of the FIGS. 1 and 2 machine.

The ice cube bagging unit of the present invention also includes a pair of aligned heat-sealing members 76 and 78 positioned to engage the outside surfaces of the tops of the front and the back, respectively, of the bag in the dispensing compartment. Heat-sealing members 76 and 78 are movable in opposite directions transverse to the front and the back of the bag toward and away from each other. After a bag has been filled with ice cubes and fingers 70*a*, 70*b*, 72*a* , and 72*b* have been moved out from the bag, the weight of the contents of the bag supports the bag and presents the front and the back of the bag vertically. As heat-sealing members 76 and 78 move toward each other, they engage the outside surfaces of the front and the back, respectively, of the bag to close the filled bag and clamp the tops of the front and the back of the filled bag. This is shown in phantom in FIG. 6. The filled bag is heat-sealed by energizing one or both of the heat-sealing members in the usual way. For the embodiment of the invention being described, only heat-sealing member 78 is energized, by a suitable power supply (not shown) connected to this heat-sealing member by a pair of leads 79. Only one of the leads 79 is shown in FIG. 3. For such an arrangement, heat sealing member 76 serves only as a clamping member.

Next, the heat-sealing members are returned to their initial positions and fingers 72*a* and 72*b* are moved toward fingers 70*a* and 70*b* to return to their initial positions. Now, the filled, sealed bag can be removed from the dispensing compartment by opening drawer 40. The bag in the dispensing compartment is separated from the next bag in the strip by tearing along the perforated line between the two either under the action of heat-sealing element 78 moving toward the clamping position for heat-sealing the bag or under the action of drawer 40 being opened to remove the filled, sealed bag.

Fingers 70*a* and 72*a* are mounted on a first shaft 80 having an axis disposed transverse to the front and the back of the bag in the dispensing compartment and fingers 70*b* and 72*b* are mounted on a second shaft 82 also having an axis disposed transverse to the front and the back of the bag in the dispensing compartment. This is shown most clearly in FIGS. 8 and 9 for shaft 82 and fingers 70*b* and 72*b*. Shaft 82 has an end section 82*a* which has a square cross-section and an intermediate section 82*b* which has a hexagonal cross-section. Finger 70*b* is mounted on shaft 82 by means of a bushing 83 having a hexagonal central opening through which the hexagonal section of shaft 82 extends and a set-screw 84. Finger 72*b* has a square opening through which the square section of shaft 82 extends. Finger 72*b* is clamped between the underside of the head of a screw 85 and the shoulder between square section 82*a* of shaft 82 and hexagonal section 82*b* of shaft 82. As shaft 82 rotates about its axis, fingers 70*b* and 72*b* turn with the shaft downward into a bag in the dispensing compartment and upward out of this bag.

When shaft 82 is moved along its longitudinal axis, the shaft slides freely through bushing 83 to move finger 72*b* in opposite directions transverse to the front and back surfaces of a bag positioned in the dispensing compartment. Finger 70*b* is restrained from movement along the axis of shaft 82 by a sleeve 86 positioned between bushing 83 and finger 70*b*. Set-screw 84 extends through sleeve 86, so that finger 70*b* serves as a stop for movements of shaft 82 to the left when viewed in FIG. 8. A collar 87 is attached to the opposite end of sleeve 86 and serves as as stop for movements of shaft 82 to the right when viewed in FIG. 8.

Shaft 80 and fingers 70*a* and 72*a* are arranged similar to shaft 82 and fingers 70*b* and 72*b*.

Figure 7:
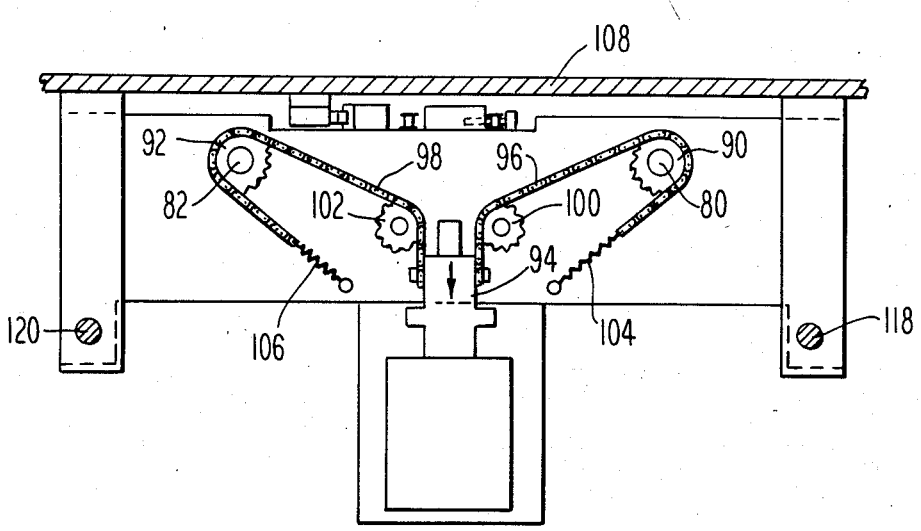
FIG. 7 is a vertical, sectional view taken along line 7—7 of FIG. 3.
Figure 8:
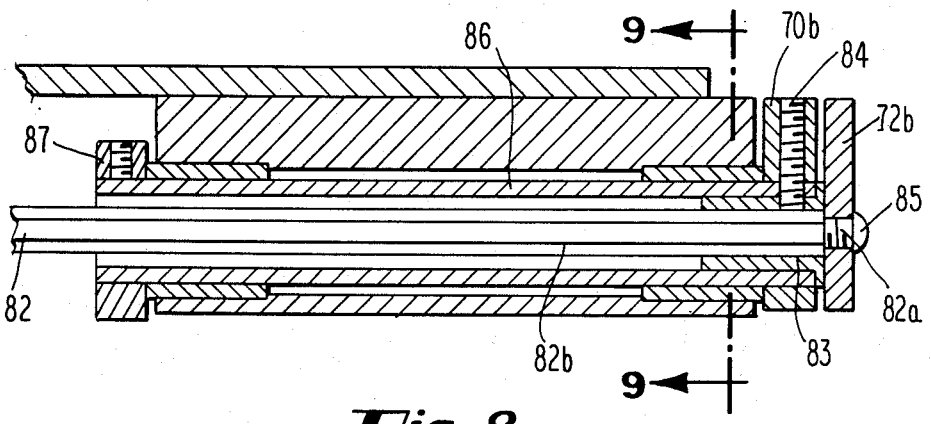
FIG. 8 is a vertical, sectional view, on an enlarged scale, taken along line 8—8 of FIG. 3.
Figure 9:
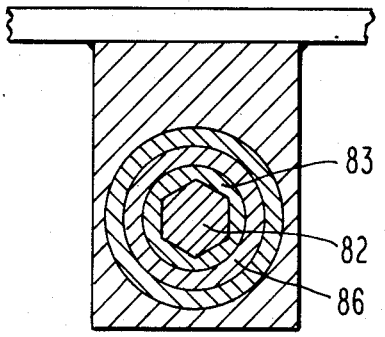
FIG. 9 is a vertical, sectional view taken along line 9—9 of FIG. 8.

FIG. 7 shows that a pair of sprockets 90 and 92 are mounted on the opposite ends of shafts 80 and 82 respectively, which are circular in cross-section. Sprockets 90 and 92 are driven in opposite rotary directions by means of a solenoid 94, a pair of chains 96 and 98, and a pair of idler sprockets 100 and 102. As solenoid 94 is energized and moves downward, the ends of chains 96 and 98, which are attached to the solenoid, move downward against the action of a pair of springs 104 and 106, respectively, and simultaneously turn shafts 80 and 82, respectively in opposite directions. This, in turn, moves fingers 70*a* and 72*a* downward by rotation in one directon and fingers 70*b* and 72*b* downward by rotation in an opposite direction. Subsequently, when solenoid 94 is de-energized, springs 104 and 106 draw chains 96 and 98, respectively, in opposite directions to simultaneously turn shafts 80 and 82 to retract fingers 70*a*, 70*b*, 72*a*, and 72*b*.

Solenoid 94, sprockets 90, 92, 100 and 102, chains 96 and 98 and springs 104 and 106 are mounted on a movable frame 108 which is arranged for movement in opposite directions transverse to the front and back of a bag positioned in the dispensing compartment. This is accomplished by means of a motor 110 and a chain 112 attached to movable frame 108 and running between a sprocket 114 at the output of motor 110 and a sprocket 116 anchored to the frame of the bagging unit. Movement of movable frame 108 is guided by a pair of rods 118 and 120 suspended between respective pairs of bushings 122, 124 and 126, 128.

As motor 110 turns, chain 112 is driven by sprocket 114 to move movable frame 108. This, in turn moves shafts 80 and 82 along their axes to move fingers 72*a* and 72*b* away from fingers 70*a* and 70*b* to open a bag in the dispensing compartment.

Movement of movable frame 108 in this direction proceeds until the movable frame engages a first limit switch 130 which is located at a position corresponding to the desired movement of fingers 72*a* and 72*b* away from fingers 70*a* and 70*b* to open a bag. Engagement of limit switch 130 by movable frame 108 is effective to interrupt turning of motor 110. At this point, movable frame 108 is in close proximity to a pair of collars 132 and 134 fixed to rods 118 and 120, respectively, to which heat-sealing member 78 is attached.

A sensor switch, represented by a pivotally mounted sensor member 135 positioned in the path of movement of a bag being opened, confirms that a bag has been opened fully. In the absence of the closing of this switch by engagement of sensor member 135 by a bag, ice cubes will not be delivered to the dispensing compartment. Instead, frame 108 is brought back to its initial position, the fingers are retracted, and the bag feeding mechanism is started again.

After a bag has been fully opened and filled with ice cubes, motor 110 is turned on to advance movement of movable frame 108 in the same direction. This movement of movable frame 108 brings it into engagement with collars 132 and 134 and causes rods 118 and 120 to move through respective bushing pairs 122, 124 and 126, 128 in the same direction, thereby coupling the forward movement of shafts 80 and 82 to heat-sealing member 78 to move this heat-sealing member to the heat-sealing position. This movement advances fingers 72*a* and 72*b* which have been retracted to their upper positions and continues until movable frame 108 engages a second limit switch 136 which is located at a position corresponding to the desired movement of heat-sealing member 78.

Movement of rods 118 and 120 is opposed by a pair of springs 140 and 142. Spring 140 is connected between the frame of the bagging unit and a movable bushing 144 through which rod 118 extends, while spring 142 is connected between the frame of the bagging unit and a movable bushing 146 through which rod 120 extends. Movable bushing 144 is connected to rod 118 by a cable 148 which extends around a pulley 150 to rod 118, while movable bushing 146 is connected to rod 120 by a cable 150 which extends around a pulley 152 to rod 120. Cable 148 is connected to heat-sealing member 76 by means of a rod 154 which extends through movable bushing 144 and bushing 124 to a support member 156 on which heat-sealing member 76 is mounted, while cable 150 is connected to heat-sealing member 76 by means of a rod 158 which extends through movable bushing 146 and bushing 128 to support member 156.

As rods 118 and 120 move to advance heat-sealing member 78 to the heat-sealing position, cables 148 and 150, connected to support member 156, draw heat-sealing member 76 to the heat-sealing position against the action of springs 140 and 142. This movement is limited by limit switch 136 and the engagement of movable bushing 144 and collar 132 and the engagement of movable bushing 146 and collar 134. The movement of movable frame 108 to limit switch 136 is set to achieve the desired clamping of the bag in the dispensing compartment between the heat-sealing members. Limit switch 136 shuts off motor 110 and actuates a brake on the motor to hold heat-sealing members 76 and 78 in place during heat-sealing.

After heat-sealing, the brake on motor 110 is released and the motor turns in an opposite direction to return movable frame 108, heat-sealing member 78 and fingers 72*a* and 72*b* to their initial positons. This movement is stopped by engagement of movable frame 108 with a third limit switch 160 located at the initial position of the movable frame. At the same time, springs 140 and 142 restore heat-sealing member 76 to its initial position and take up the slack which tends to develop in cables 148 and 150 as rods 118 and 120 return to their initial positions.

Figure 10:
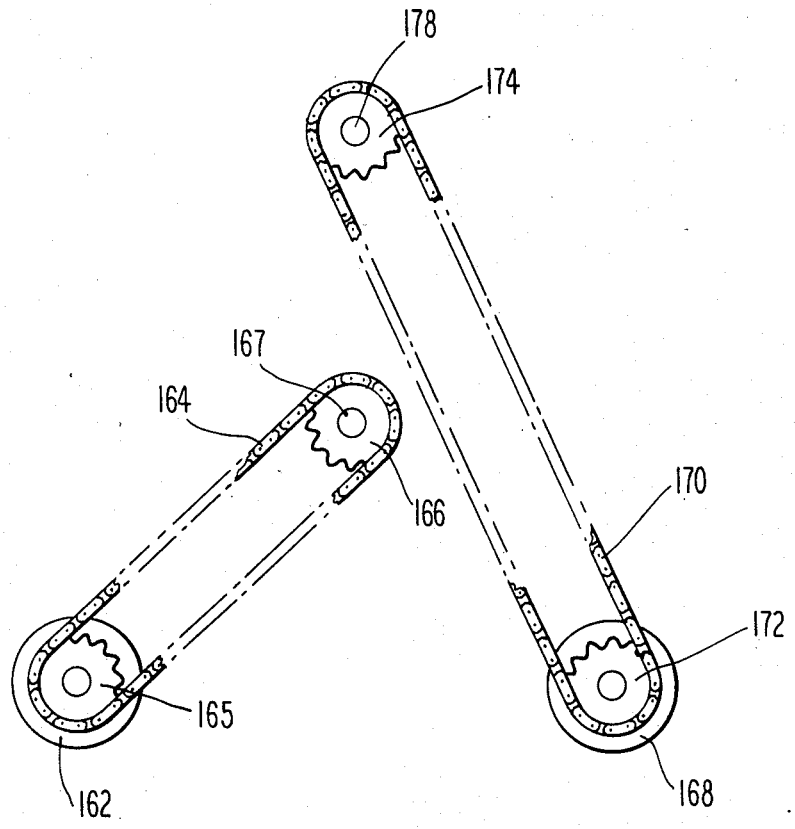
FIG. 10 is a rear view of the ice cube storage portion of the FIGS. 1 and 2 machine.
Figure 11:
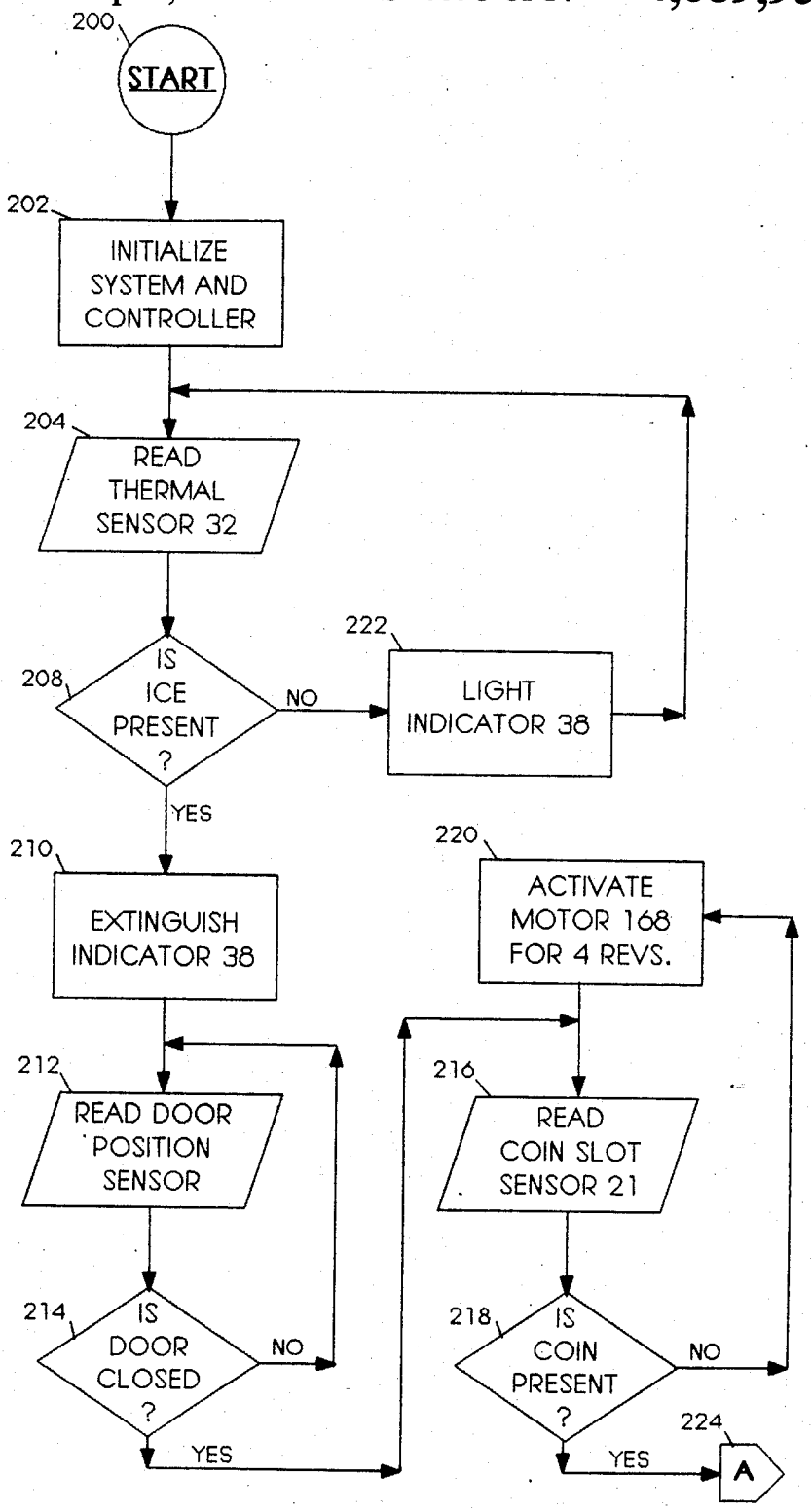
FIGS. 11–20 are flowcharts of the computer control program of the FIGS. 1 and 2 machine.
Figure 12:
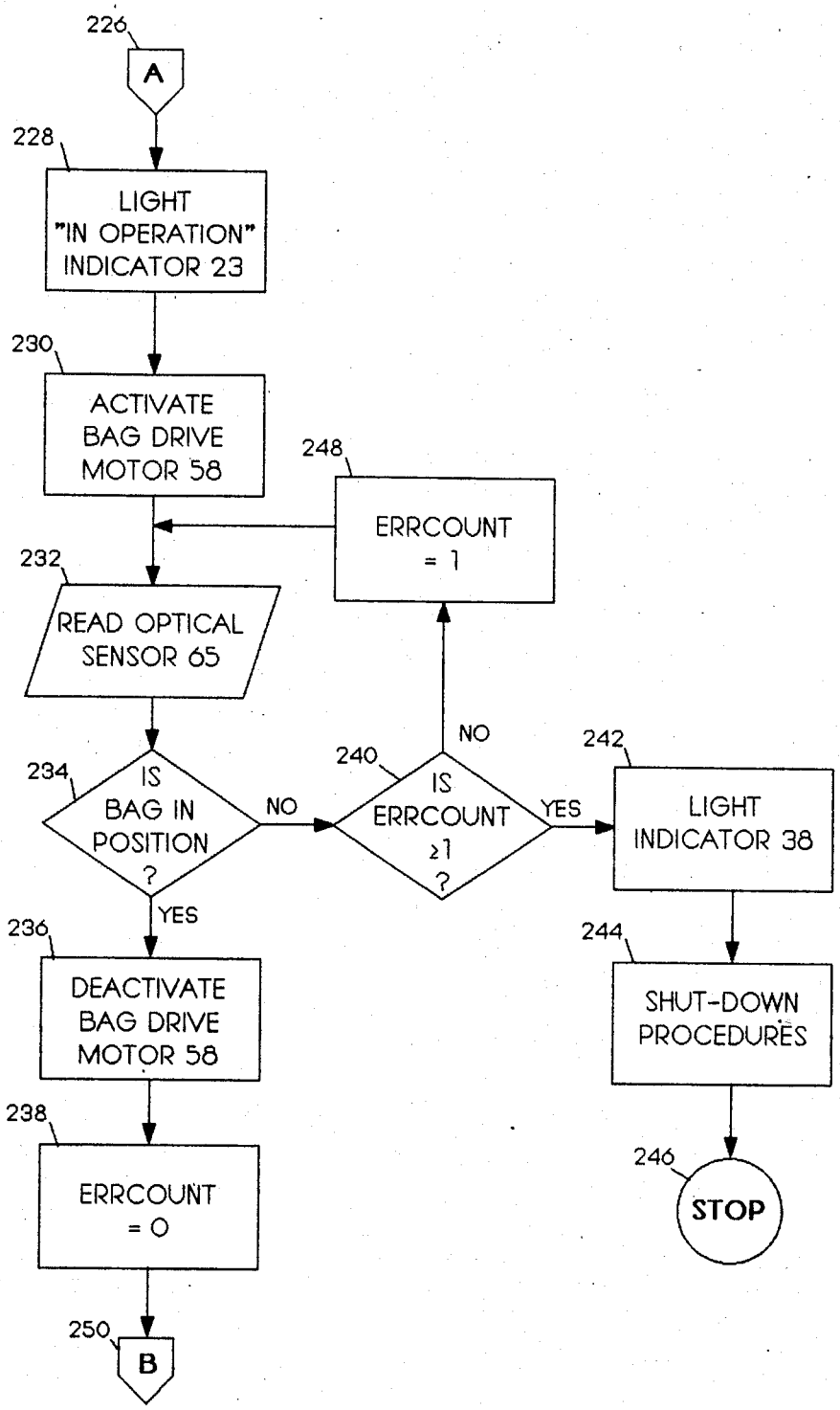
Figure 13:
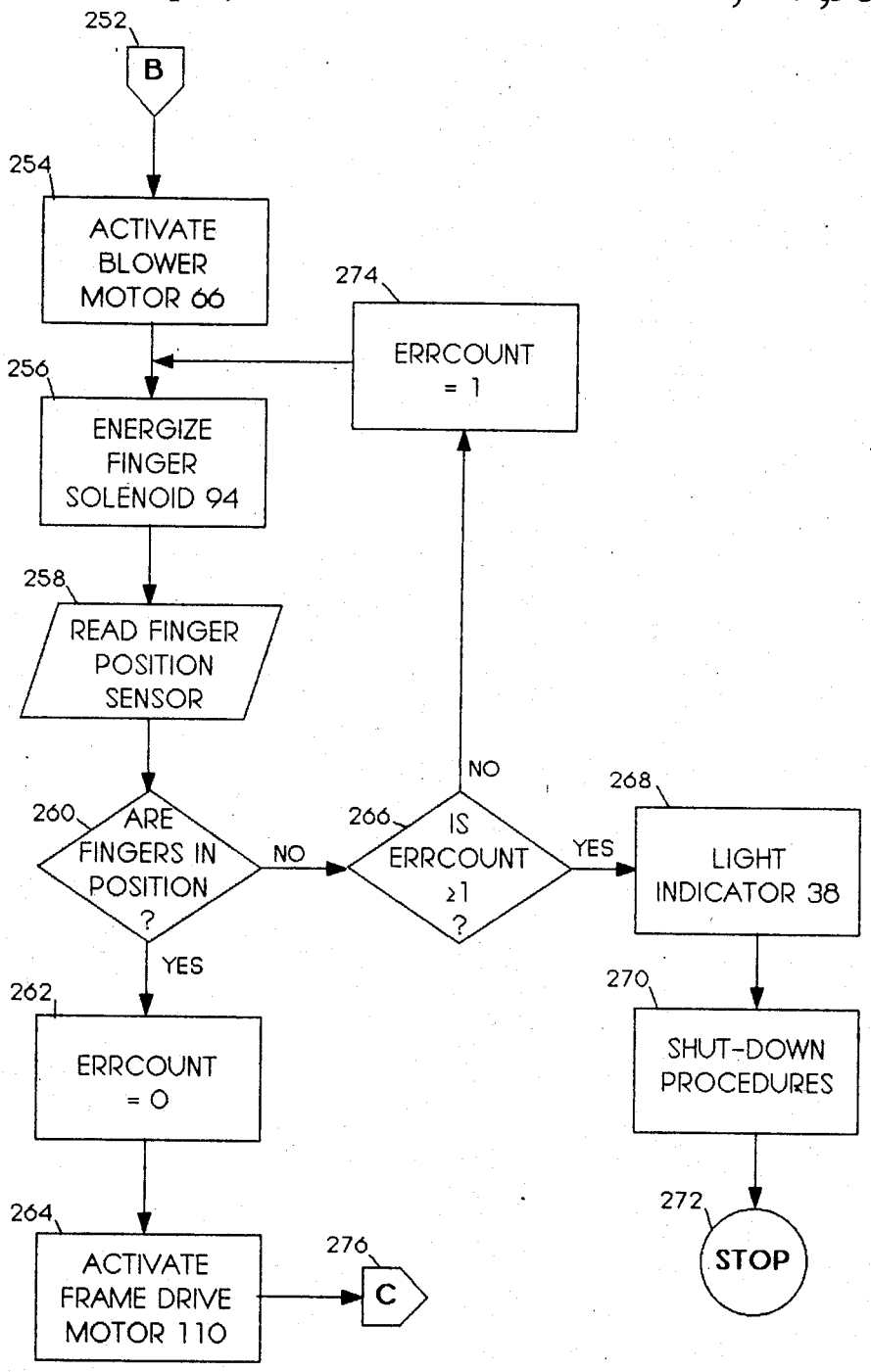
Figure 14:
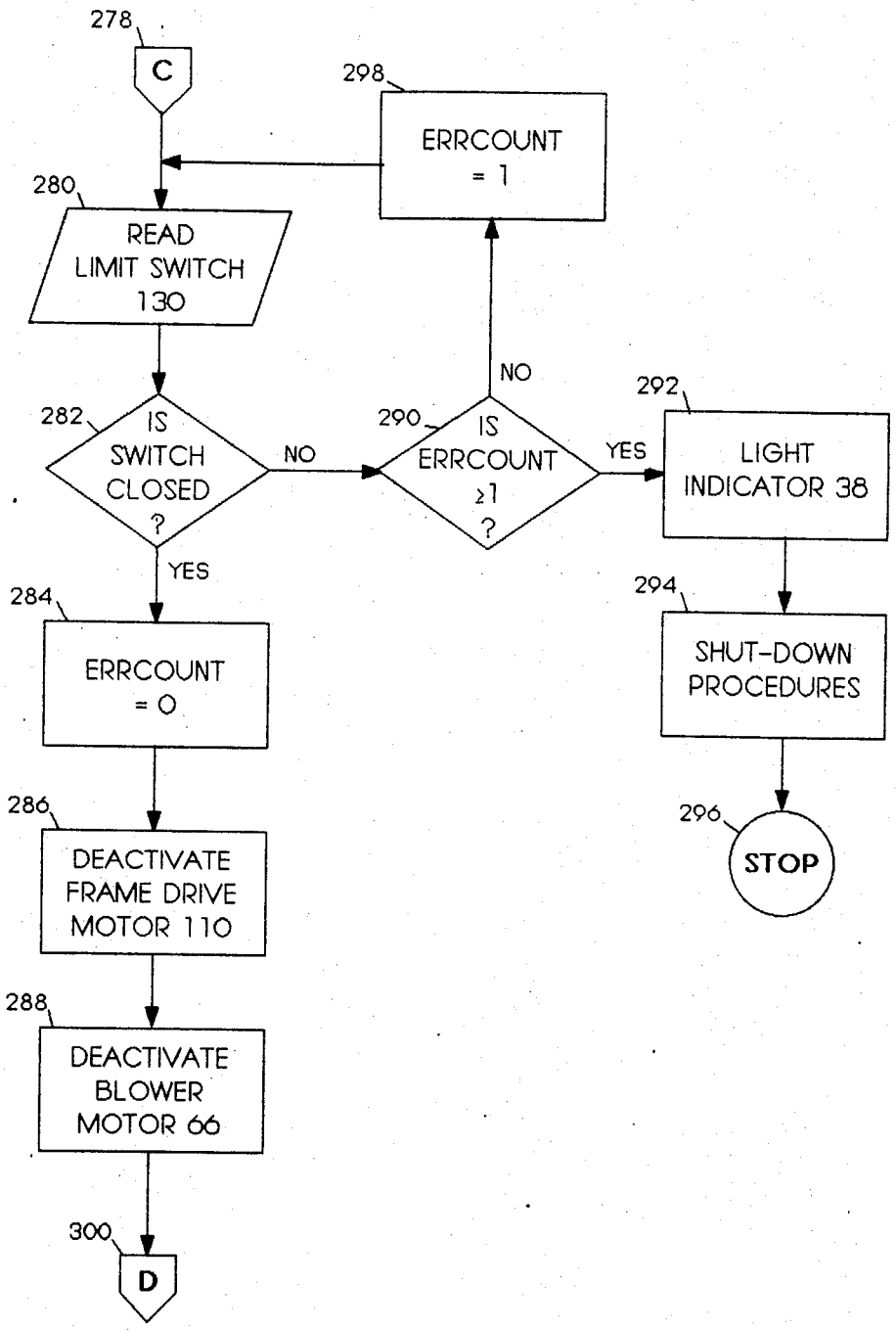
Figure 15:
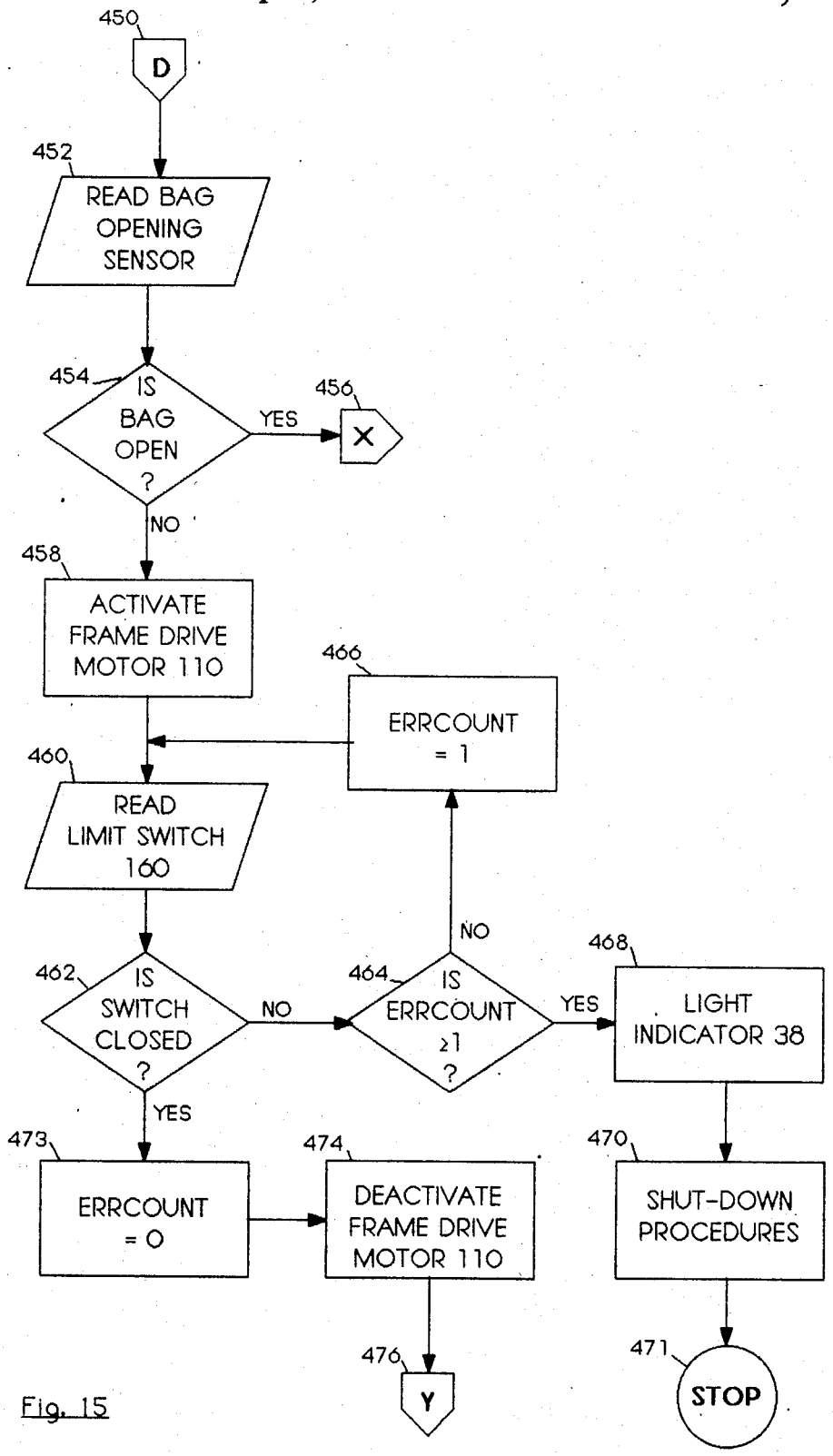
Figure 16:
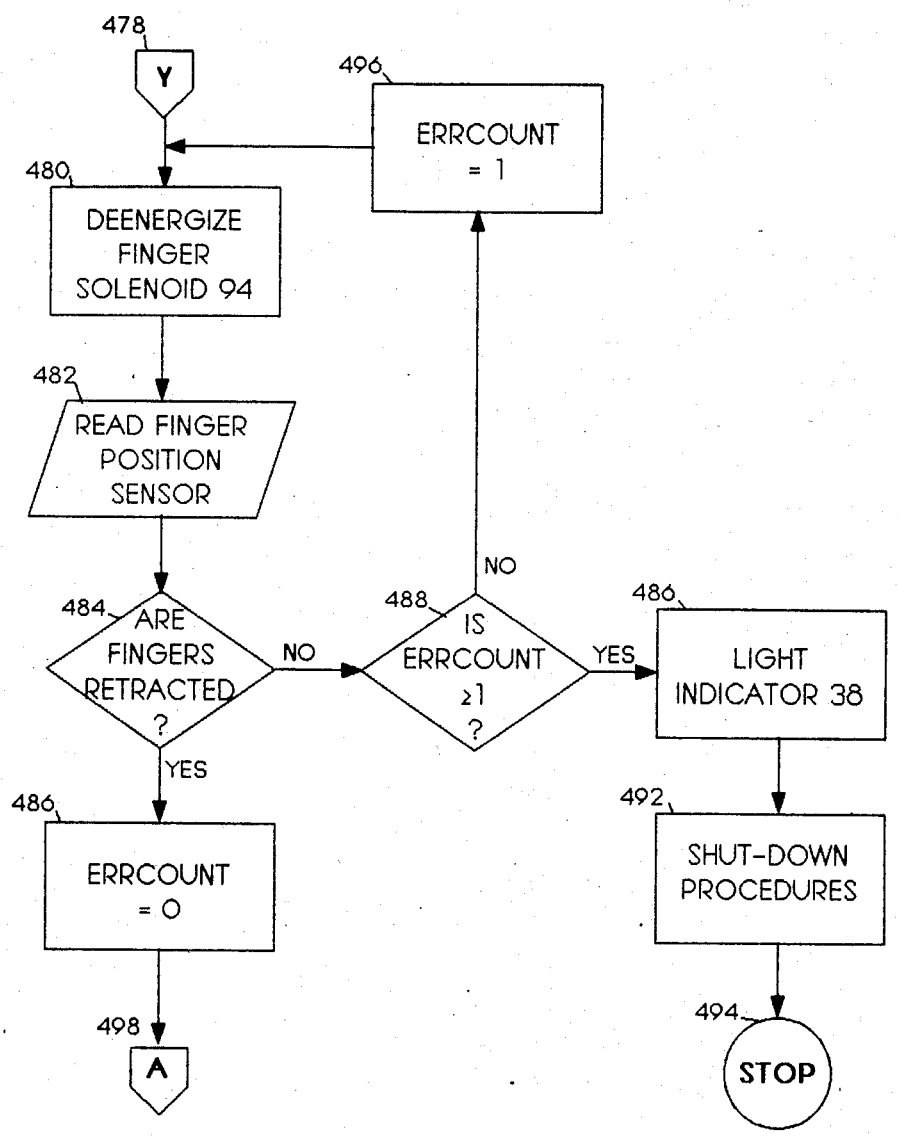
Figure 17:
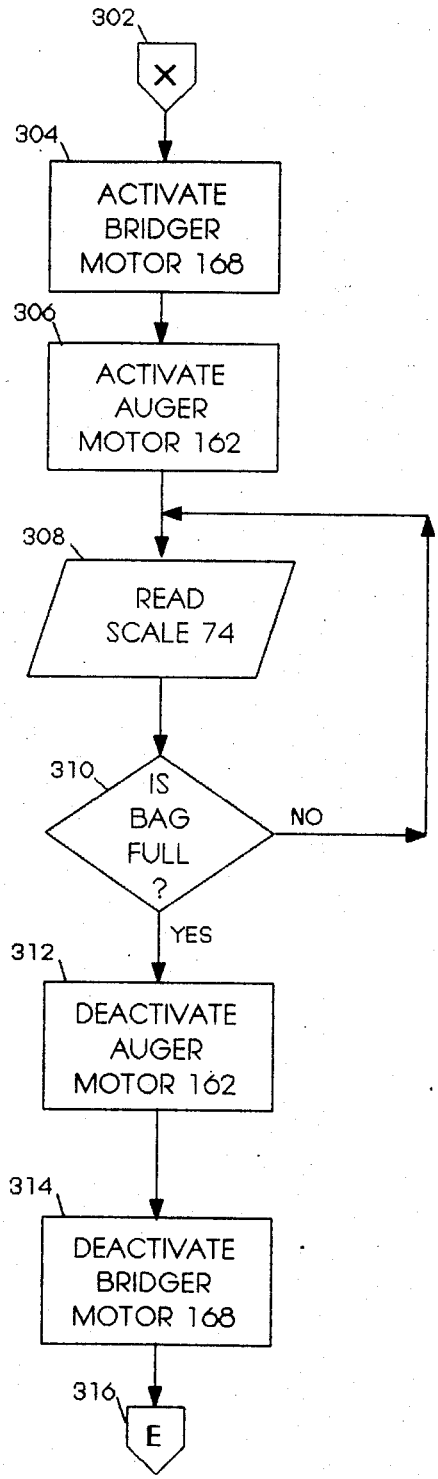
Figure 18:
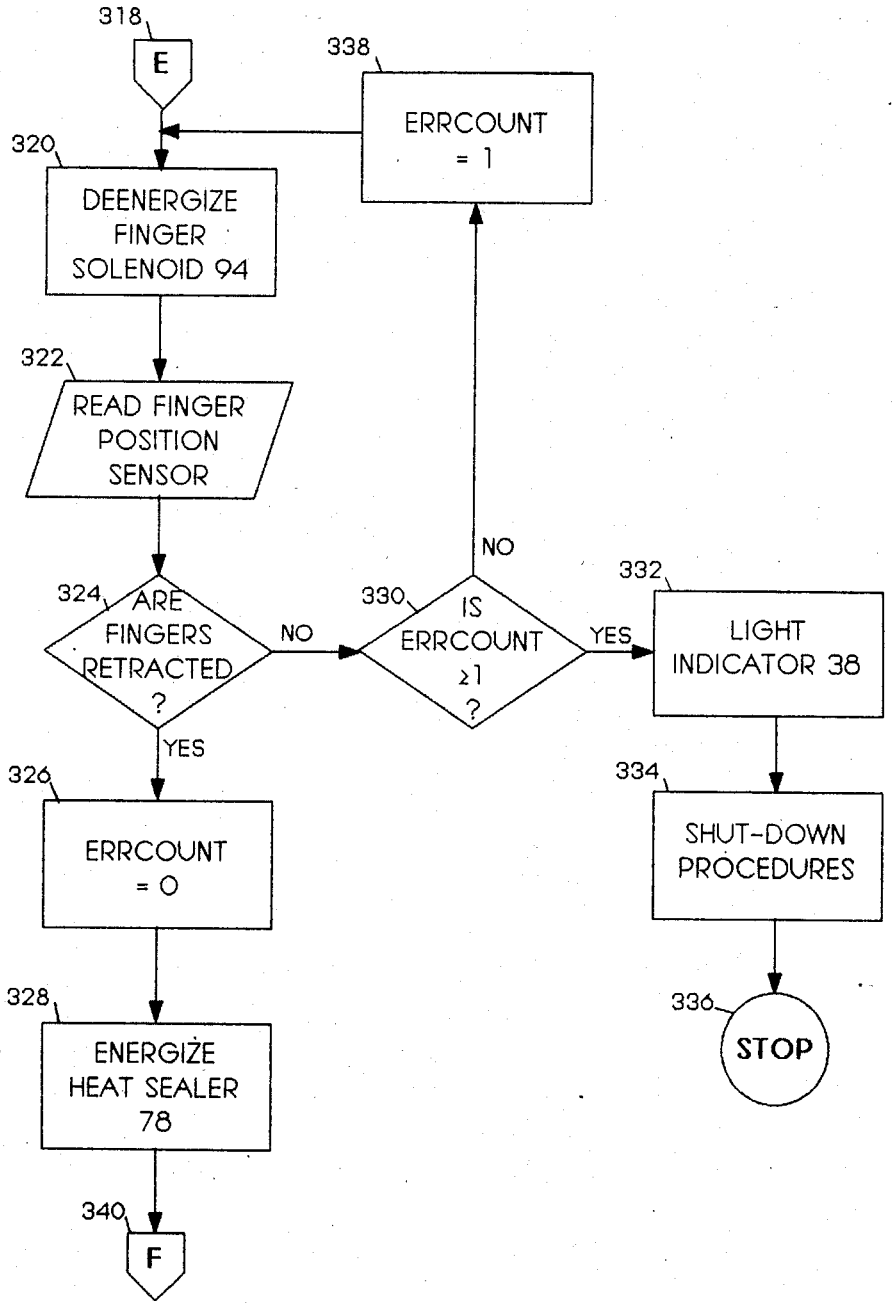
Figure 19:
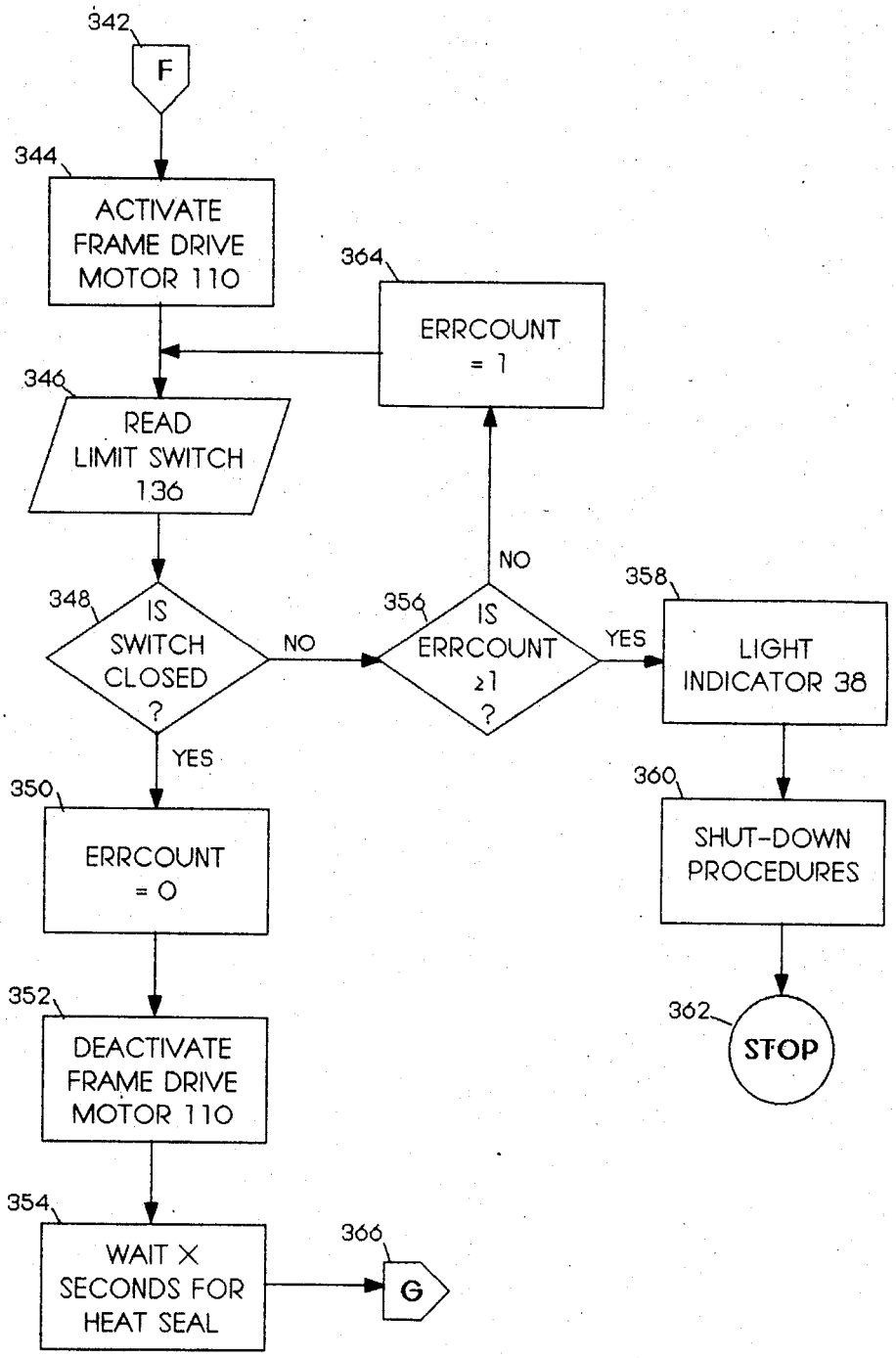
Figure 20:
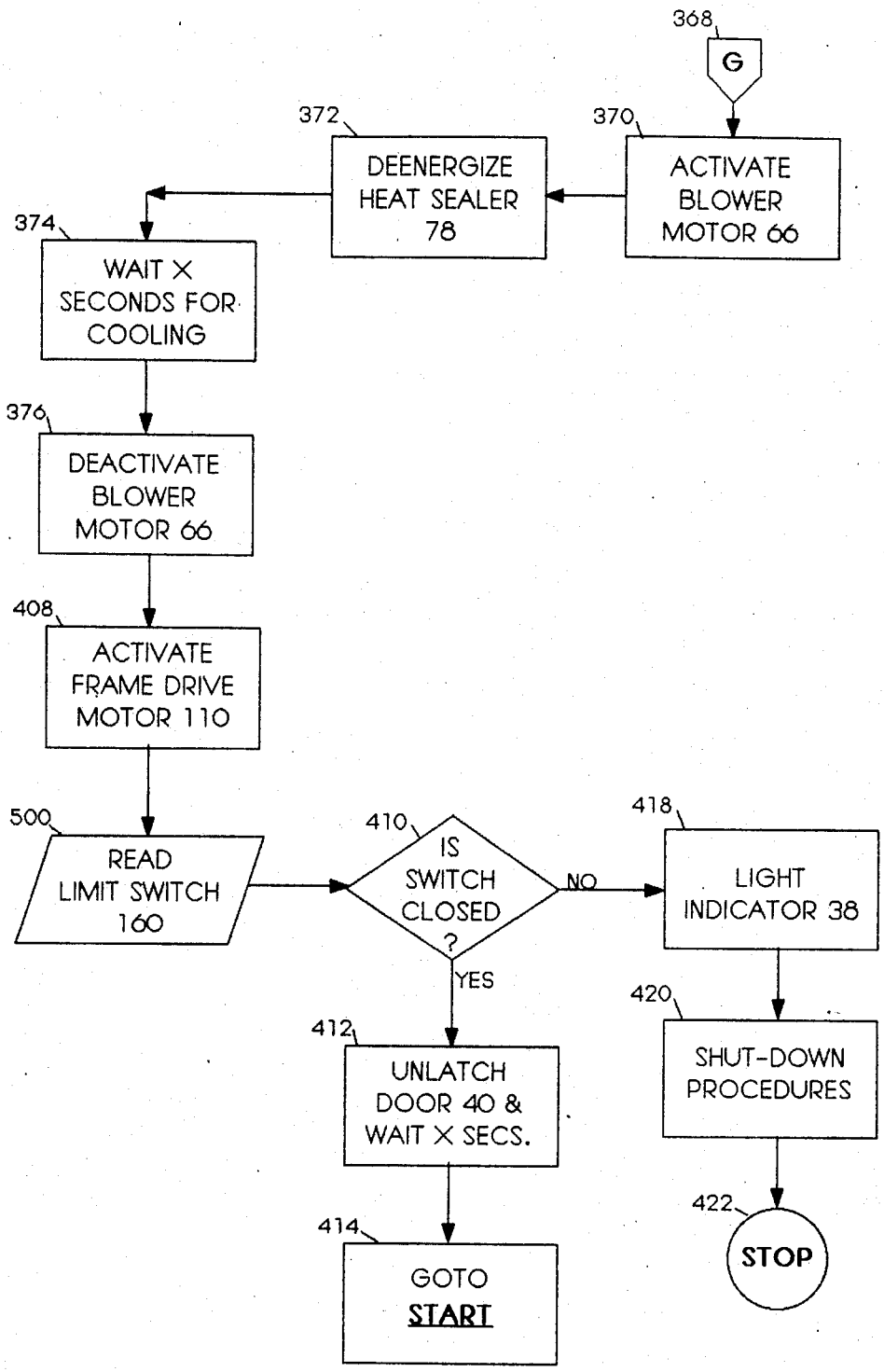

As shown in FIG. 10, auger 16 is driven by a motor 162 connected to the auger by a chain 164 running between a sprocket 165 mounted at the output of motor 162 and a sprocket 166 mounted on the same shaft 167 as is the auger. Bridger 14 is driven by a motor 168 connected to the bridger by a chain 170 running between a sprocket 172 mounted at the output of motor 168 and a sprocket 174 mounted on the same shaft 178 as is the bridger.

Operation of the ice cube bagging unit is initiated by actuation of command unit 20 [216] which supplies a signal to computer 22. Computer 22 operates according to program instructions which are shown as flow charts in FIGS. 11–20. In the following discussion, reference numerals enclosed within square brackets will refer to programmmatic steps as depicted in FIGS. 11–20. Computer 22, in turn, [218–228] causes motor 58 to draw a bag into the dispensing compartment [230]. Optical sensor 65 supplies a signal to computer 22 which shuts off motor 58 [232, 234, 236, 240–248] and actuates air blower 66 to partially open the bag in the dispensing compartment [254]. Computer 22 also actuates solenoid 94 [256] to move fingers 70*a*, 70*b*, 72*a*, and 72*b* downward after a suitable delay to allow air blower 66 to partially open the bag before the fingers are moved downward [260, 266–274].

After a second suitable delay, which allows the fingers to move downward into a bag in the dispensing compartment, computer 22 turns on motor 110 [264] to drive movable frame 108 and fingers 72*a* and 72*b* to open fully the bag in the dispensing compartment. When movable frame 108 reaches limit switch 130, this limit switch causes computer 22 to stop motor 110 [280, 282, 284, 286, 290–298].

Computer 22 then determines whether the bag is fully open [452,454]. If not, frame 108 is retracted to its initial position, and fingers 70*a*, 70*b*, 72*a*, and 72*b* are moved out of the bag [458–498]. Another bag loading cycle is then initiated [226]. If the bag has been fully opened, the system proceeds to the ice dispensing operation in which computer 22 actuates bridger motor 168 and auger motor 162 to deliver ice cubes to the fully open bag in the dispensing compartment [304, 306]. Upon sensing the desired amount of ice cubes in the bag, scale 74 supplies a signal to computer 22 which, in turn, stops motor 162 to discontinue the delivery of ice cubes [308–314].

After another suitable delay, during which computer 22 deactivates solenoid 94 to move fingers 70*a*, 70*b*, 72*a*, and 72*b* out of the filled bag [320–326, 330–338] computer 22 energizes heat-sealing member 78 to seal the bag [328] and again turns on motor 110 to drive movable frame 108 and heat-sealing members 76 and 78 to clamp the tops of the filled bao for heat-sealing the bag [344]. When movable frame 108 reaches limit switch 136, this limit switch causes computer 22 to stop motor 110 [346–352, 356–364].

Computer 22 also actuates air blower 66, after the filled bag has been sealed, to cool the heat-seal and heat-sealing member 78 [370]. If the filled bag has not yet been torn away from the next succeeding bag in the strip by the movement of heat-sealing member 78, the air from the air blower deflects along the surface of the strip of bags to the heat-seal. If the filled bag has been torn away from the next succeeding bag, the air from the air blower is blown into the general area of the heat-seal. Computer 22 causes air blower 66 to stay on for a prescribed period of time, for example, fifteen minutes, to cool down heat-sealing member 78 [374].

Next, computer 22 activates motor 110 to retract frame 108 to its original position, thereby actuating limit switch 160 [408–410].

Computer 22 now releases the interlock of the dispensing compartment [412] and the filled, sealed bag of ice can be removed by pulling drawer 40 outward in a direction transverse to the front and back surfaces of the filled, sealed bag. If the filled, sealed bag has not yet been torn away from the next succeeding bag, it now tears away as drawer 40 is pulled outward. After drawer 40 is returned to its initial position by movement in the opposite transverse direction, the bagging unit is ready to fill and seal another bag of ice cubes.

Computer 22 controls two other functions. After a prescribed period of time, the computer turns off air-blower 66 if another filling and sealing cycle has not been initiated [202]. In addition computer 22 causes bridger motor 168 to turn periodically, during extended periods of non-use of the bagging unit, to break apart ice cubes in storage bin 12 [220].

The foregoing has set forth exemplary and preferred embodiments of the present invention. It will be understood, however, that various alternatives will occur to those of ordinary skill in tne art without departure from the spirit and scope of the present invention.

We claim:

1. An article bagging unit comprising:

means for storing a strip of bags interconnected by perforated lines extending between the top edge of the back of each bag and the bottom of the next bag;

means for storing articles to be deposited in said bags;

a dispensing compartment within which said bags are filled with said articles;

means for delivering said articles to said dispensing compartment;

means for feeding said bags to said dispensing compartment and for positioning said bags to receive said articles from said article delivering means;

means for opening a bag positioned in said dispensing compartment to receive articles from said article delivering means and for closing and sealing a bag filled with said articles, said bag opening, closing and sealing means including:

(a) an air blower for blowing air into the top of a bag to separate the tops of the front and the back of said bag and partially open said bag, (b) a first pair of fingers movable downward into said bag and upward out from said bag and fixed relative to opposite directions transverse to said front and said back of said bag, (c) a second pair of fingers movable downward into said bag and upward out from said bag and also movable in said transverse directions away from and toward said first pair of fingers, (d) a pair of aligned heat-sealing members positioned to engage the outside surfaces of said tops of said front and said back of said bag and movable in said transverse directions toward and away from each other (e) first drive means for moving said first pair of fingers and said second pair of fingers downward into said bag and upward out from said bag, (f) second drive means for moving (1) said second pair of fingers in said transverse directions away from and toward said first pair of fingers and (2) said heat-sealing members in said transverse directions toward and away from each other, and (g) power supply means for energizing at least one of said heat-sealing members;

and control means for:

(a) actuating said bag feeding and positioning means to position a bag in said dispensing compartment to receive said articles from said article delivering means, (b) actuating said air blower to separate the tops of the front and the back of said bag to partially open said bag, (c) actuating said first drive means to move said first and said second pairs of fingers into said partially open bag, (d) actuating said second drive means to move said second pair of fingers in a first of said transverse directions away from said first pair of fingers to spread said front and said back of said partially open bag to fully open said bag, (e) actuating said article delivering means to fill said fully open bag with a prescribed amount of said articles, (f) actuating said first drive means to move said first and said second pairs of fingers upward out from said filled bag, (g) actuating said second drive means to move said heat-sealing members in said transverse directions toward each other to close said filled bag and clamp said tops of said front and said back of said filled bag between said heat-sealing members, (h) applying power from said power supply means to said heat-sealing member to energize said heat-sealing member to seal said filled bag, and (i) actuating said second drive means to move (1) said second pair of fingers in the second of said transverse directions toward said first pair of fingers and (2) said heat-sealing members in said transverse directions away from each other.

2. An article bagging unit according to claim 1 further including a scale positioned in said dispensing compartment and upon which said bags rest as they are filled with said articles and said control means are responsive to said scale to shut off said article delivering means when said scale senses a prescribed weight of said articles in a bag resting on said scale.

3. An article bagging unit according to claim 2 wherein said dispensing compartment is movable in said transverse directions between a first position in which said bags are filled with said articles and a second position in which said filled, sealed bags are removed from said dispensing compartment.

4. An article bagging unit according to claim 3 wherein said bags are stored in a roll.

5. An article bagging unit according to claim 1 wherein:

(a) said bag feeding means include a sensor for sensing the passage of said strip of bags and for developing a signal when a bag is positioned in said dispensing compartment, and (b) said control means are responsive to said sensor signal to shut off said bag feeding means.

6. An article bagging unit according to claim 1 wherein said bag opening, closing and sealing means include:

(a) a first shaft having an axis disposed transverse to said front and said back of said bag and upon which one of said first pair of fingers is mounted and one of said second pair of fingers is mounted for rotary movement with said first shaft, (b) a second shaft having an axis disposed transverse to said front and said back of said bag and upon which the second of said first pair of fingers is mounted and the second of said second pair of fingers is mounted for rotary movement with said second shaft, and (c) means responsive to said first drive means for simultaneously turning said first shaft and said second shaft in opposite directions.

7. An article bagging unit according to claim 6 wherein said first shaft and said second shaft are responsive to said second drive means to move said second pair of fingers in said transverse directions.

8. An article bagging unit according to claim. 7 wherein said bag opening, closing and sealing means include means for coupling movement of said first shaft and said second shaft to said heat-sealing members.

9. An ice cube making and bagging machine comprising:

means for storing a strip of bags interconnected by perforated lines extending between the top edge of the back of each bag and the bottom of the next bag;

means for making ice cubes;

means for storing said ice cubes;

means for breaking apart ice cubes in said ice cube storing means;

means for sensing the presence of at least a prescribed minimum amount of ice cubes in said ice cube storing means;

a dispensing compartment within which said bags are filled with said ice cubes;

means for delivering said ice cubes to said dispensing compartment;

means for feeding said bags to said dispensing compartment and for positioning said bags to receive said ice cubes from said ice cubes delivering means;

means for opening a bag positioned in said dispensing compartment to receive ice cubes from said ice cubes delivering means and for closing and sealing a bag filled with said ice cubes, said bag opening, closing and sealing means including:

(a) an air blower for blowing air into the top of a bag to separate the tops of the front and the back of said bag and partially open said bag, (b) a first pair of fingers movable downward into said bag and upward out from said bag and fixed relative to opposite directions transverse to said front and said back of said bag, (c) a second pair of fingers movable downward into said bag and upward out from said bag and movable in said transverse directions away from and toward said first pair of fingers, (d) a pair of aligned heat-sealing members positioned to engage the outside surfaces of said tops of said front and said back of said bag and movable in said transverse directions toward and away from each other, (e) first drive means for moving said first pair of fingers and said second pair of fingers downward into said bag and upward from said bag, (f) second drive means for moving (1) said second pair of fingers in said transverse directions away from and toward said first pair of fingers and (2) said heat-sealing members in said transverse directions toward and away from each other, and (g) power supply means for energizing at least one of said heat-sealing members;

and control means responsive to said sensing means for checking the presence of said prescribed minimum amount of ice cubes in said ice cube storing means and then for:

(a) actuating said bag feeding and positioning means to position a bag in said dispensing compartment to receive said ice cubes from said ice cubes delivering means, (b) actuating said air blower to separate the tops of the front and the back of said bag to partially open said bag, (c) actuating said first drive means to move said first and said second pairs of fingers into said partially open bag, (d) actuating said second drive means to move said second pair of fingers in a first of said transverse directions away from said first pair of fingers to spread said front and said back of said partially open bag to fully open said bag, (e) actuating said ice cubes delivering means to fill said fully open bag with a prescribed amount of said ice cubes, (f) actuating said first drive means to move said first and said second pairs of fingers upward out from said filled bag, (g) actuating said second drive means to move said heat-sealing members in said transverse directions toward each other to close said filled bag and clamp said tops of said front and said back of said filled bag between said heat-sealing members, (h) applying power from said power supply means to said heat-sealing member to energize said heat-sealing member to seal said filled bag, and (i) actuating said second drive means to (1) move said second pair of fingers in the second of said transverse directions toward said first pair of fingers, and (2) said heat-sealing members in said transverse directions away from each other.

10. An ice making and bagging machine according to claim 9 further including third drive means for moving said ice cube breaking means.

11. An ice cube making and bagging machine according to claim 10 wherein said control means actuate said third drive means periodically.

12. An ice cube making and bagging machine according to claim 11 further including a scale positioned in said dispensing compartment and upon which said bags rest as they are filled with said ice cubes and said control means are responsive to said scale to shut off said ice cubes delivering means when said scale senses a prescribed weight of said ice cubes in a bag resting on said scale.

13. An ice cube making and bagging machine according to claim 12 wherein said dispensing compartment is movable in said transverse directions between a first position in which said bags are filled with said ice cubes and a second position in which said filled, sealed bags are removed from said dispensing compartment.

14. An ice cube making and bagging machine according to claim 13 wherein said bags are stored in a roll.

15. An ice cube making and bagging machine according to claim 14 wherein:

(a) said bag feeding means include a sensor for sensing the passage of said strip of bags and for developing a signal when a bag is positioned in said dispensing compartment, and (b) said control means are responsive to said sensor signal to shut off said bag feeding means.

* * * * *